US007076836B1

(12) United States Patent
Butka

(10) Patent No.: US 7,076,836 B1
(45) Date of Patent: Jul. 18, 2006

(54) INTEGRATED HINGE AND TEMPORARY DOOR CHECKER

(75) Inventor: Stephen J. Butka, Columbus, OH (US)

(73) Assignee: Honda Motor Co., Ltd., Tokyo (JP)

( * ) Notice: Subject to any disclaimer, the term of this patent is extended or adjusted under 35 U.S.C. 154(b) by 65 days.

(21) Appl. No.: 10/878,761

(22) Filed: Jun. 28, 2004

(51) Int. Cl.
*E05D 11/08* (2006.01)

(52) U.S. Cl. ..... 16/342; 16/334; 16/344; 16/374

(58) Field of Classification Search ..... 16/342, 16/344, 332, 335, 321, 374, 375, 322, 341, 16/334; 296/146.11, 146.12
See application file for complete search history.

(56) References Cited

U.S. PATENT DOCUMENTS

| | | | | |
|---|---|---|---|---|
| 4,532,675 | A * | 8/1985 | Salazar | 16/335 |
| 4,794,669 | A * | 1/1989 | Sanders | 16/341 |
| 4,800,624 | A * | 1/1989 | Whitefoot et al. | 16/332 |
| 5,018,243 | A * | 5/1991 | Anspaugh et al. | 16/335 |
| 5,509,175 | A * | 4/1996 | Baughan et al. | 16/332 |
| 5,918,347 | A * | 7/1999 | Morawetz | 16/322 |
| 5,924,170 | A | 7/1999 | Papke et al. | |
| 6,332,243 | B1 | 12/2001 | Kim | |
| 6,334,236 | B1 | 1/2002 | Kalliomaki | |
| 6,438,794 | B1 | 8/2002 | Ng et al. | |
| 6,467,126 | B1 * | 10/2002 | Yezersky et al. | 16/86 C |
| 6,481,056 | B1 | 11/2002 | Jesse | |
| 6,581,243 | B1 * | 6/2003 | Parizel | 16/334 |
| 6,591,451 | B1 | 7/2003 | Gruber et al. | |
| 6,739,020 | B1 * | 5/2004 | Morawetz | 16/334 |
| 6,901,634 | B1 * | 6/2005 | Shaw et al. | 16/344 |
| 2001/0022011 | A1 * | 9/2001 | Vittorio | 16/334 |
| 2003/0140455 | A1 * | 7/2003 | Audisio | 16/334 |

FOREIGN PATENT DOCUMENTS

| | | | |
|---|---|---|---|
| DE | 3418891 | C2 * | 4/1994 |
| DE | 19909500 | A1 * | 9/2000 |
| EP | 1331340 | A1 * | 7/2003 |
| FR | 2705389 | A1 * | 11/1994 |
| FR | 2710365 | A3 * | 3/1995 |
| GB | 2160256 | A * | 12/1985 |
| JP | 2000160914 | A * | 6/2000 |
| JP | 2001220939 | A * | 8/2001 |
| KR | 2002022414 | A * | 3/2002 |
| KR | 2002093233 | A * | 12/2002 |
| WO | WO 9303248 | A1 * | 2/1993 |

* cited by examiner

*Primary Examiner*—Chuck Y. Mah
(74) *Attorney, Agent, or Firm*—Rankin, Hill, Porter & Clark LLP; Vincent Ciamacco

(57) ABSTRACT

An integrated hinge system that provides for temporary checking of a vehicle door is provided, the system including a hinge pin, a door hinge bracket, a pillar hinge bracket, and a contact body that is affixed to the hinge pin. A latching device is affixed to the door hinge bracket and rotates with the door hinge bracket relative to the hinge pin and the contact body. The contact body defines engagement points that a latching portion of the latching device engages to releasably retain the door hinge bracket in any one of at least two angular orientations relative to the pillar hinge bracket.

14 Claims, 3 Drawing Sheets

INTEGRATED HINGE AND TEMPORARY DOOR CHECKER

CROSS REFERENCE TO RELATED APPLICATION

The disclosure of U.S. patent application Ser. No. 10/878,897, filed Jun. 28, 2004, is expressly incorporated herein by reference in its entirety.

BACKGROUND OF THE INVENTION

During the manufacture and assembly of vehicles, it is often necessary to perform certain operations with the vehicle body and doors assembled. Automated application of sealer to body joints and door joints and painting of the vehicle are examples of such operations. Concurrent door and body painting provides uniform color and quality between the body and doors. During the sealing and painting operations, the vehicle door must be opened and closed numerous times. Because the painting, etc. is often performed by automated systems, position and repeatability of locating the doors is of primary importance.

Door hinges used on the finished vehicle may also be used during these intermediate assembly steps such as painting. However, the permanent door checking devices used on the finished vehicle typically are not in place during these intermediate steps because they can be damaged by the harsh environment in paint operations (ovens, paint, use of electrostatic equipment, solvents, and/or preparatory cleaners). As a substitute, temporary door checking devices are used to hold doors in desired positions during these intermediate steps. Typically, a temporary checking device is affixed to the door and vehicle body before the operation begins and removed after the operation is complete and often reused. The temporary checking device may be positioned at the same location in which the permanent door checking device used on the finished vehicle will be placed.

Because most temporary checking devices are self contained, requiring nothing except a place to be mounted, they tend to be relatively complex and time consuming to install and remove. This increases overall vehicle manufacturing costs. What is desired is a temporary checking device that works in conjunction with elements already in place on the vehicle, the temporary checking device being simple and easily installed and removed.

BRIEF SUMMARY OF THE INVENTION

The present invention provides an improvement over the prior art by providing a temporary checking device that works in conjunction with elements of a vehicle hinge that will remain in the vehicle's final configuration. Moreover, the checking device is simpler and more easily installed and removed than checking devices known in the art.

In accordance with the present invention, a hinge system is provided that includes a hinge pin, a door hinge bracket receiving the hinge pin, a pillar hinge bracket also receiving the hinge pin, a contact body affixed to the hinge pin and including a plurality of engagement points, and a latching device movable with respect to the contact body. The door hinge bracket is rotatably movable with respect to the pillar hinge bracket. The latching device, which is affixed to the door hinge bracket and moves therewith, includes a head selectively engageable with the contact body engagement points during respective movement between the door hinge bracket and pillar hinge bracket. Interaction of the contact body and latching device provides locations where the door may be temporarily checked or stopped with respect to the rest of the vehicle so that the door may be releasably maintained in a desired angular orientation (degree of opening).

BRIEF DESCRIPTION OF THE FIGURES

These and further features of the present invention will be apparent with reference to the following description and drawings, wherein.

DETAILED DESCRIPTION OF THE INVENTION

Figure 1:
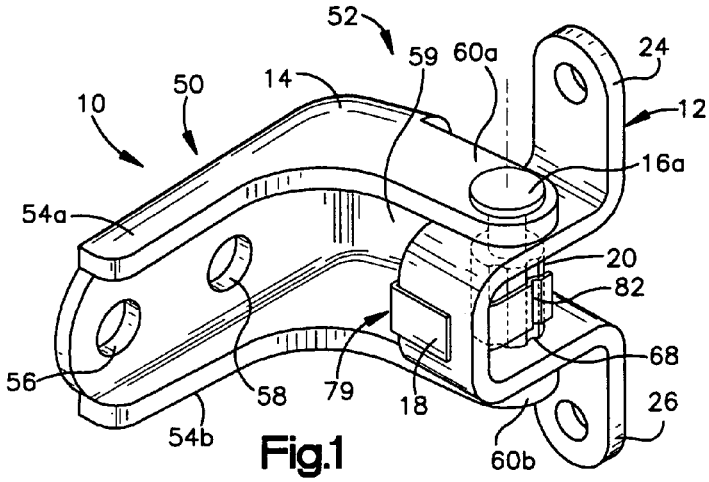
FIG. 1 is a front and right side perspective view of a first embodiment of the hinge system of the present invention.

The hinge system 10 of the present invention comprises a door hinge bracket 12, pillar hinge bracket 14, a hinge pin 16, a latching device 18, and a contact body 20. Preferably, the hinge system 10 is used as both an upper hinge and a lower hinge to pivotally secure a door to a vehicle body. Alternatively, the hinge system 10 may be used as only one of the upper and lower hinges. The door hinge bracket 12 is rotatably secured to the pillar hinge bracket 14 via the hinge pin 16 and the angular orientation of the door hinge bracket and the door secured thereto may be checked or releasably maintained in any one of two or more positions via interaction of the latching device 18 and the contact body 20, as described hereinafter.

The door hinge bracket 12 is affixable to a vehicle door 48 and includes a first or upper ear 24 extending vertically upward and a second or lower ear 26 extending vertically downward. Each ear 24, 26 defines a hole 28, 30 for the passage of a fastener to affix the door hinge bracket 14 to the vehicle door 48. Integrally formed with the first and second ears 24, 26 and extending therebetween is a U-shaped intermediate member 32.

The U-shaped intermediate member has an upper leg 34, a lower leg 36, and a base 42 interconnecting the upper and lower legs 34, 36. The upper leg 34 extends between and interconnects the upper ear 24 and the base 42. The lower leg 36 extends between and interconnects the lower ear 26 and the base 42. Each leg 34, 36 of the U-shaped member defines a hole 38, 40 through which the hinge pin 16 extends. The base 42 of the U-shaped member 32, which is oriented vertically, may optionally define a hole 42*a* (FIG. 6B) for receipt of a fastener 46 for the latching device 18, as will be described hereinafter.

The pillar hinge bracket 14 of the hinge system 10 is affixable to a vehicle pillar 22. The pillar hinge bracket 14 is generally L-shaped and includes a pillar flange 50 and a pin bracket 52. The pillar flange 50 has a generally planar base wall 51 from which a upper and lower raised peripheral walls 54*a*, 54*b* extend. The pillar flange 50 defines two holes 56, 58 for the passage of fasteners that affix the pillar hinge bracket 14 to the vehicle pillar 22.

The pin bracket 52 is oriented generally perpendicular to the door flange 50 and includes a base wall 59 and upper and lower raised peripheral walls 60*a*, 60*b*. The base wall 59 of the pin bracket 52 integrally extends from the base wall 51 of the pillar flange 50. The upper and lower raised peripheral walls 60*a*, 60*b* of the pin bracket 52 integrally merge with the upper and lower raised peripheral walls 54*a*, 54*b*, respectively, of the pillar flange 50, as illustrated. Preferably, the pin bracket base wall 59 is shorter in length than the pin bracket peripheral walls 60*a*, 60*b* such that the pin bracket peripheral walls 60*a*, 60*b* extend past the end of the pin bracket base wall 59, as illustrated.

Each of the upper and lower pin bracket peripheral walls 60*a*, 60*b* define a hole 62, 64 near their distal ends, as illustrated. When the hinge system 10 is assembled, the holes 62, 64 defined by the pin bracket peripheral walls 60*a*, 60*b* align with the holes 38, 40 formed in the upper and lower legs 34, 35 of the U-shaped member 32 of the door hinge bracket 12 and cooperate to receive the hinge pin 16.

The hinge pin 16 includes an enlarged upper head 16*a*, a cylindrical body 16*b*, and a swaged lower head 16*c*. The hinge pin 16 has a length, and the cylindrical body 16*b* has a diameter, so as to permit the hinge pin 16 to extend through the aligned holes 62, 64; 38, 40 in the pillar bracket 14 and the door bracket 12, respectively. As such, the enlarged upper head 16*a* rests upon the upper pin bracket peripheral wall 60*a*, the body 16*b* passes through the holes 62, 38, 40, 64, and the swaged lower head 16*c* (which is formed by known riveting or heading techniques on the lower end of the pin body 16*b*), is downwardly adjacent the lower pin bracket peripheral wall 60*b*. As such, the hinge pin 16 is held in place and cannot be removed without destroying the hinge pin 16 and/or one of the hinge brackets 12, 14.

Preferably, and as will be described more fully hereinafter, the hinge pin 16 is held in place so as to be non-rotatably affixed to the pillar hinge bracket 14, while the door hinge bracket 12 is rotatable about the hinge pin 16. Although not illustrated, it is preferred that bushings be received in the holes 38, 40 formed in the upper and lower legs 34, 35 of the U-shaped member 32 of the door hinge bracket 12. The bushings facilitate rotation of the door hinge bracket 12 about the stationary hinge pin 16. It is believed that such bushings are well known to those skilled in the art.

Numerous means for fixing the hinge pin 16 to the pillar hinge bracket 14 are known in the art and can be used interchangeably with the present structure. Such known means include splines, non-circular cross-sectional profiles (i.e., D-shaped cross sections at upper end of the hinge pin body 16*b* and the hole 62 in the upper pin bracket peripheral wall 60*a*), and crimping the hinge pin 16 to the pillar hinge bracket 14.

Figure 5:
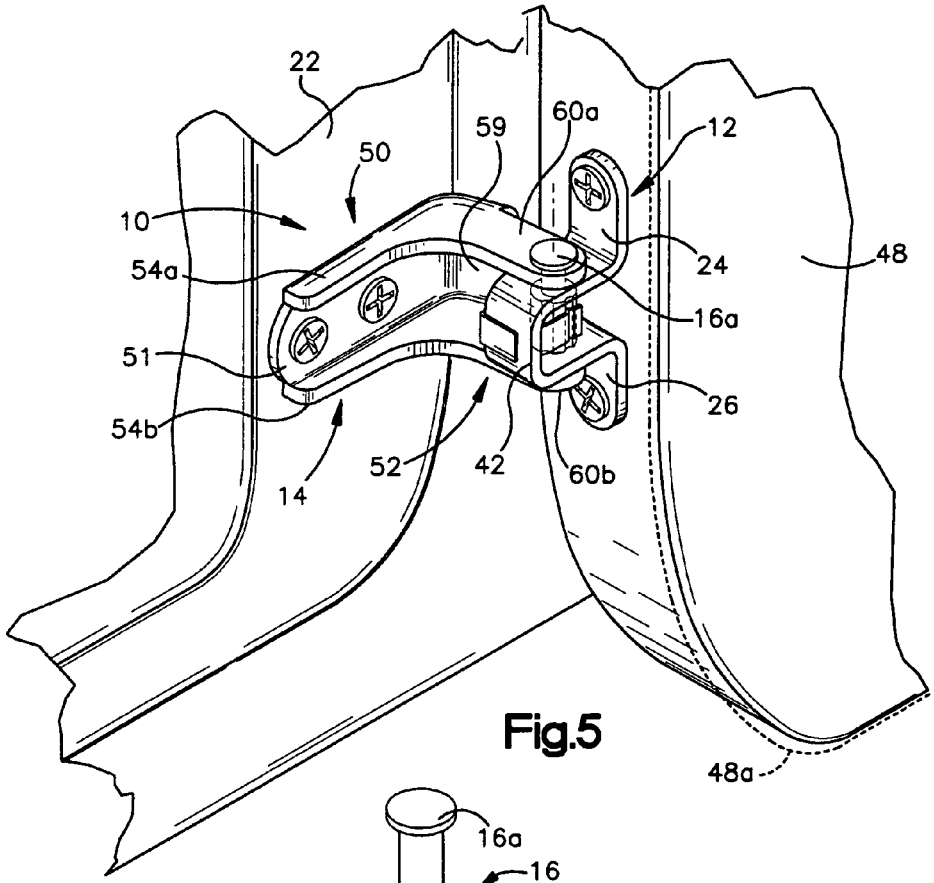
FIG. 5 is a front and right side perspective view of the hinge system of FIG. 1 attached to a vehicle body and door, and in which door is in the first orientation or closed position and the vehicle fender is removed for purposes of clarity.
Figure 4:
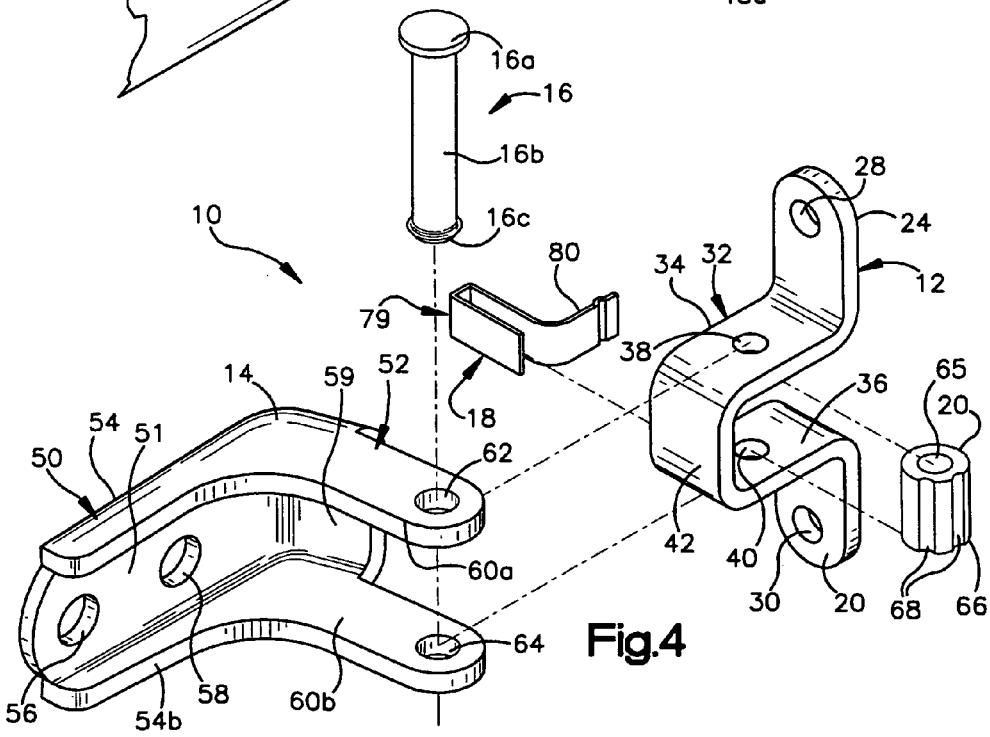
FIG. 4 is an exploded view of the hinge system of FIG. 1.

In FIG. 5 the hinge system 10 is shown with the door hinge bracket 12 affixed to the door 48 and the pillar hinge bracket 14 affixed to the vehicle 22. The door 48 is in a closed position whereby the door outer skin 48*a* (shown in phantom) is spaced from the vehicle body and generally parallel to the vehicle body. It is noted that the front fender of the vehicle 22 is not shown in FIG. 5 for purposes of clarity of illustration.

It is noted that the door hinge bracket 12, pillar hinge bracket 14, and hinge pin 16 described to this point are generally conventional and well known in the art.

The contact body 20 is preferably a thick walled cylinder having a center bore 65 and a generally circular outside surface 66. Two or more catches or engagement points 68 are formed in the outside surface 66 at predetermined positions that correspond to positions of the vehicle door 48. More specifically, and as will be appreciated from the following description, the predetermined positions for the catches or engagement points 68 are positions that correspond with desired door angular orientations. Such desired door angular orientations are angular orientations in which it is desired to releasably retain the door (i.e., full closed, full open, half open, etc.).

Preferably, the catches or engagement points 68 are notches or recesses formed in the outside surface 66, which is otherwise generally smooth and circular. Alternatively, the engagement points 68 may be raised portions or ridges that extend or project from the outside surface 66 of the contact body 20. Further, the engagement points 68 may be defined by a combination of notches or recesses and raised portions. In this regard it is noted that while it is preferred that the outer surface of the contact body 20, with the exception of the engagement points 68, be generally circular, this is not mandatory.

Rather, while it may be desirable to have a generally arcuate or radiused surface between the two or more engagement points 68 over which slides the latching device 18, for reasons that will be apparent from the remainder of the description, the other portions of the outside surface 66 of the contact body 20 may have any configuration or shape. It is believed, for instance, that making the outside surface 66 more irregular (i.e., non-circular) may assist in properly orienting or aligning the contact body with the hinge pin 16 (and ultimately the door) so as to assist in assembling the hinge system 10. Therefore, the present invention is not to be limited to the currently preferred and illustrated generally circular contact body 20.

The contact body 20 is preferably formed from a durable plastic material, such as ABS plastic, and is preferably injection molded. As such the engagement points may be localized notches (i.e. indentations) or raised portions (i.e. tabs). Alternatively, the contact body 20 may be formed by extrusion/pultrusion techniques, and the engagement points 68 may by lengthwise-extending notches (grooves) extending into the contact body or lengthwise-extending raised portions (ridges) that project from the contact body 20. Forming the contact body by extrusion/pultrusion offers the advantage of permitting a contact body blank of extended or infinite length to be formed and thereafter cut into individual contact bodies of the desired length. It is further appreciated that the contact body may be formed as a cylinder and that the engagement points 68 may later be formed in the contact body by known pressing operations. As such, it is contemplated that the contact body may be formed from materials other than plastic (e.g. metal, wood, dense foam), or may be formed from more than one material (i.e., composite or laminate material, metal core over-molded or insert molded with plastic, etc.) so as to exhibit desired physical properties and durability while being low in cost.

Figure 3A:
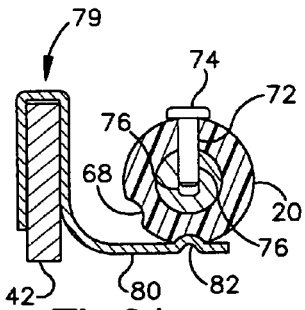
FIG. 3A is a top cross-sectional view illustrating a portion of the hinge system of FIG. 1 in the first angular orientation.

The hinge pin 16 passes through the bore 65 of the contact body 20 and is affixed to the contact body 20. The contact body 20 may preferably be affixed to the hinge pin with a fastener 70, such as illustrated in FIG. 3A, wherein an aperture 72 is formed in the contact body 20 that extends transversely through the contact body 20 and aligns with a similar aperture 76 formed in the hinge pin 16. The hinge pin aperture 76 may be a blind bore, as illustrated, or may extend through the hinge pin 16. A screw or pin 74 extends through the contact body aperture 72 and into an aligned hinge pin aperture 76 to fix the contact body 20 in position on the hinge pin 16. As such, the contact body 20 will be fixed to the hinge pin 16 and will not be movable relative to the hinge pin 16.

Keeping in mind that it is important for the contact body to be immovably affixed to the hinge pin 16, and that the hinge pin 16 is stationary (i.e., does not rotate during movement of the door hinge bracket thereabout), it is contemplated that numerous alternative methods may be used to affix the contact body 20 to the hinge pin 16. For example, the hinge pin 16 may be press-fit into the contact body 20 to form a friction fit (via hoop stress), or may be adhesively secured to the contact body 20.

Figure 2:
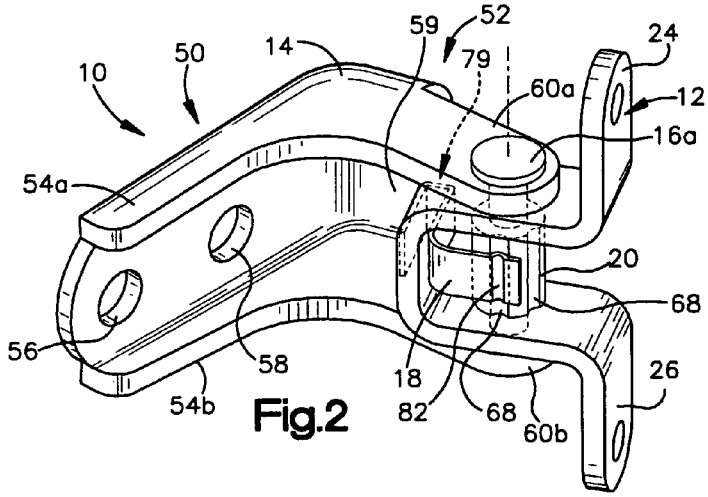
FIG. 2 is a front and right side perspective view of the first embodiment of the hinge system of the present invention in an open position or second angular orientation.

The latching device 18 extends between the door hinge bracket base 42 and the contact body 20 and serves to engage the contact body 20 so as to releasably retain the door 48 in any one of at least two angular orientations relative to the host vehicle (e.g., compare FIGS. 1 and 2). The latching device 18 is preferably affixed to the U-shaped member 32 of the door hinge bracket 12 using one of a number of possible clip systems (attachment portions). Preferably, the latching device 18 is affixed to the door hinge bracket 12 in a manner that allows for easy removal of the latching device 18 from the door hinge bracket 12, as will be apparent from the following description of the various embodiments of the latching device 18.

With reference to FIGS. 1–5, the latching device 18 includes an attachment portion 79 and a biased engagement portion 80. The attachment portion 79 is generally U-shaped and wraps around the base 42 of the door hinge bracket 12, and serves to secure the latching device 18 to the door hinge bracket 12. The attachment portion 79 is conveniently secured to the base 42 by sliding the attachment portion onto or over the base 42.

The biased engagement portion 80 is a somewhat elongated arm that extends away from the base 42 and has a distal end in sliding engagement with the outer surface 66 of the contact body 20. The engagement portion 80 includes a latching portion 82 that is adapted to be releasably received by the engagement points 68 in the outer surface of the contact body 20. The latching portion 82 is shaped so as to be received by the engagement points 68 of the contact body 20.

Should the contact body engagement points 68 be elongated grooves, as illustrated, the latching portion 82 will be a correspondingly or matingly profiled elongated ridge, which is shaped to be received in the elongated groove. Similarly, should the engagement points 68 be in the form of elongated ridges, then the latching portion 82 may be a correspondingly profiled elongated groove or may be an elongated ridge, as desired. Should the engagement points 68 be individual or localized detents or dimple-like recesses, then the latching portion 82 may preferably be a similarly shaped raised portion, such as may be provided by a ball-bearing or the like. As will be appreciated, it is contemplated that, so long as the latching function between the latching portion 82 and the engagement points 68 be relatively positive, yet overcome with a predetermined force, the latching portion 82 and the engagement points may take on any number of forms without departing from the scope and spirit of the present invention. More complex mating engagement point 68/latching portion 82 designs are contemplated, including spring-biased balls or spring loaded pins (for the latching portion 82) that are snapped into detents or holes (for the engagement portion). However, it is believed that these more complex designs may not be necessary and may therefore unnecessarily increase the costs of the hinge assembly 10.

Moreover, the latching device 18 may be formed from any number of materials. Preferably, the latching device 18 is formed from a metal material (i.e., steel, spring steel, aluminum) which will provide a spring-like effect to the engagement portion 80 and thereby bias or urge the latching portion 82 into engagement with the outside surface 66 of the contact body 20. Similar effects can be achieved should the latching device 18 be formed from plastic, or a combination of steel and plastic. It is currently believed that a metal material will be preferred for reasons of cost, durability, and ease of manufacture.

With reference to FIGS. 6A–6E, a series of alternative embodiments are illustrated wherein the latching device is more positively secured to the door hinge bracket 12. Initially it is noted that these various alternative embodiments of the latching device are identical in many respects to the latching device 18 described hereinbefore, so common reference numbers are used when appropriate.

Figure 6A:
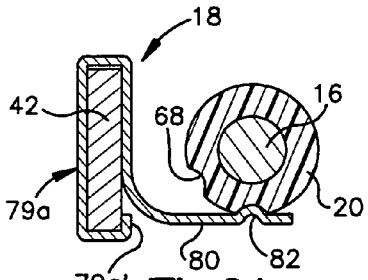
FIG. 6A is a cross-sectional view similar to FIG. 3A, but incorporating an alternate latching device.

FIG. 6A illustrates a first alterative latching device 18 having an attachment portion 79*a* and an engagement portion 80. The attachment portion 79*a* extends almost entirely around the base 42 of the door hinge bracket 12, and includes a tab or finger 79*a*' at its distal end that snaps over an edge of the base 42. The finger 79*a*' serves to positively attach the latching device 18*a* to the door hinge bracket 12 and to retain the latching device 18*a* on the door hinge bracket 12. Insofar as the latching device 18 is made from a resilient material, the attachment portion 79*a* may be simply pushed onto or over the base 42 (by resiliently deforming the attachment portion 79*a* (finger 79*a*') away from the engagement portion 80) to secure the latching device 18 to the door hinge bracket 12. The latching device 18 may be released from the door hinge bracket 12 by prying (perhaps with a screwdriver) or pulling the finger 79*a*' away from the base 42 and sliding the latching device away from or off of the base 42.

It is noted that the finger 79*a*' is shown snapped over an inner edge of the base 42. It is contemplated that the finger 79*a*' could instead snap over the outer edge of the base 42, or that the finger could snap into a recess or opening in the base, such as opening 42*a* shown in FIG. 6B.

Figure 6B:
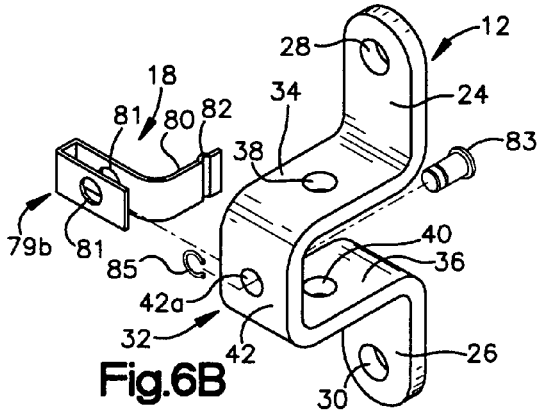
FIG. 6B is an exploded view of a portion of the hinge system similar to FIG. 1, but incorporating another alternate latching device.

FIG. 6B illustrates a latching device 18 that includes a pair of aligned holes 81 in the attachment portion 79*b*. A pin 83 extends through the aligned holes 81 and the related hole 42*a* in the base, and receives a spring clip 85 at its distal end to releasably, yet securely, attach the spring clip 18 to the door hinge bracket 12.

Figure 6C:
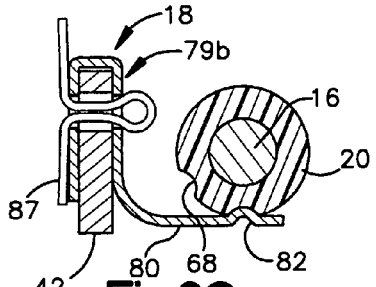
FIG. 6C is a cross-sectional view similar to FIG. 3A, but incorporating another alternate latching device.

FIG. 6C illustrates a related latching device 18 wherein a cotter pin 87 releasably attaches the latching device to the door hinge bracket base 42. Naturally, it is considered apparent that other forms of releasable fasteners, such as spring clips, may also be used interchangeably with the pin/spring clip and cotter pin illustrated herein.

Figure 6D:
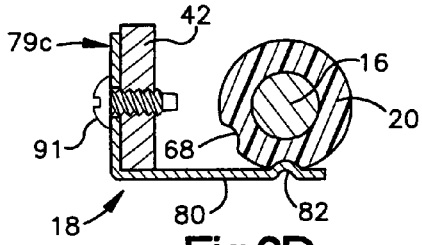
FIG. 6D is a cross-sectional view similar to FIG. 3A, but incorporating a further alternate latching device.

FIG. 6D illustrates a further preferred embodiment of the latching device 18 wherein the latching device is generally L-shaped. As such, the attachment portion 79*c* is generally planar and extends along one surface (an outer surface) of the base 42 of the door hinge bracket 12. The attachment portion 79*c* defines an opening that aligns with a threaded bore formed in the base 42. The opening and threaded bore cooperate to receive a fastener, such as a screw 91, that positively attaches the latching device 18 to the door hinge bracket 12.

Figure 6E:
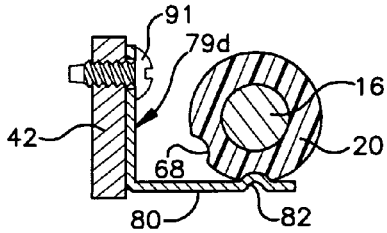
FIG. 6E is a cross-sectional view similar to FIG. 6A, but illustrating an additional alternate latching device; and, FIG. 7 is a front and right side perspective view of the hinge system of the present invention incorporating the latching device of FIG. 6D.
Figure 7:
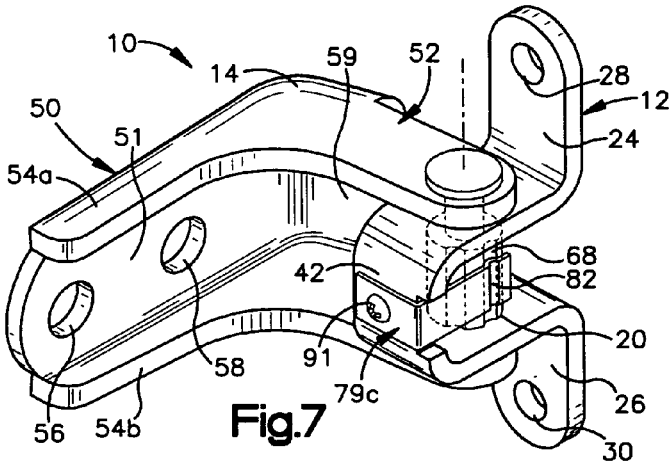

FIG. 6E illustrates a further preferred embodiment of the latching device 18 wherein the latching device is generally L-shaped, and is generally similar to the embodiment of FIG. 6D. As such, the attachment portion 79*d* is generally planar and extends along one surface (an inner surface) of the base 42 of the door hinge bracket 12. The attachment portion 79*d* defines an opening that aligns with a threaded bore formed in the base 42. The opening and threaded bore cooperate to receive a fastener, such as a screw 91, that positively attaches the latching device 18 to the door hinge bracket 12.

With regard to the embodiments of FIGS. 6D–6E, it is believed apparent that other fasteners may be used in place of the screw 91 that is illustrated. For example, a push-type non-removable plastic fastener having outwardly extending locking tabs may be used to affix the latching device 18 to the door hinge bracket 12. Further, the screw 91 may be placed at any location along the length of the attachment portion 79*c*, 79*d*. For example, in FIG. 6D the screw 91 is generally midway along the length of the attachment portion 79*c* whereas in FIG. 6E the screw is closer to the distal end of the attachment portion 79*d*. It is believed that moving the position of the screw along the length of the attachment portion 79*c*, 79*d* may ease insertion and removal of same. It is also contemplated that the screw 91 may be placed at non-ninety degree angle relative to the attachment portion 79*c*, 79*d* and the base 42 to further facilitate insertion and removal of the screw 91.

The pillar hinge bracket 14 functions to affix the hinge system 10 to a pillar 22 of a vehicle body. The door hinge bracket 12 affixes the hinge system 10 to the vehicle door 48. The contact body 20 is a temporary stop for the fixed latching device 18. Thus, as the vehicle door 48 is moved the latching device 18 is moved from one engagement point 68 on the contact body 20 to another. The engagement portion 80 of the latching device 18 is biased against the contact body 20 and holds the vehicle door 48 in any one of at least two angular orientation corresponding to receipt of the latching portion 82 in one or the other of the engagement points 68.

In a preferred method of assembling the hinge system 10, the contact body 20 is loosely placed within the U-shaped member 32 of the door hinge bracket 12. The pillar hinge bracket 14 is put in position around the door hinge bracket 12 and the hinge pin 16 is inserted through the pillar hinge bracket 14, door hinge bracket 12, and contact body 20 to hold the group together. The contact body 20 is affixed around the hinge pin 16 such that no rotation between the hinge pin 16 and the contact body 20 is possible, as described hereinbefore. Affixing of the contact body 20 to the hinge pin 16 may be by mechanical means, friction (press fit), adhesives or the like, as noted previously.

In this regard it is noted that the contact body 20 must be carefully oriented with respect to the door hinge bracket so that the engagement between the latching portion 82 of the latching device 18 and the engagement points 68 of the contact body 20 will precisely correspond with the desired checking positions of the vehicle door. The lower end 16*c* of the hinge pin body 16*b* is then swaged or headed to hold the hinge pin 16 in place. The latching device 18 is then affixed to the base 42 of the door hinge bracket 12. Thereafter, the so-assembled hinge system 10 may be affixed to the vehicle body (pillar) 22 and the vehicle door 48 so as to rotatably attach the door to the vehicle.

The latching device 18 works efficiently as part of a hinge system 10 upon a vehicle. The hinge system is manufactured with the contact body 20 fixed to the hinge pin 16 and both the door hinge bracket 12 and pillar hinge bracket 14 receiving the hinge pin 16. As noted hereinbefore, there is no relative motion between the pillar hinge bracket 14, the hinge pin 16, and the contact body 20. Rather, the door hinge bracket 12 is free to move with respect to the hinge pin 16, the pillar hinge bracket 14, and the contact body 20.

Figure 3B:
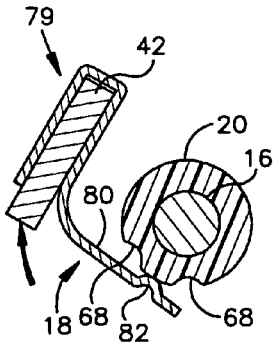
FIG. 3B is a top cross-sectional view illustrating a portion of the hinge system of FIG. 1 in an intermediate position between the first and second angular orientations.
Figure 3C:
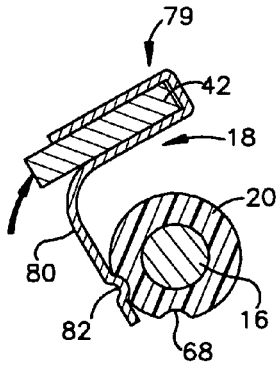
FIG. 3C is a top cross-sectional view illustrating a portion of the hinge system of FIG. 1 in the second angular orientation.

This hinge system 10 is adapted for use during intermediate vehicle assembly and especially during a painting operation wherein the doors 48 or door hinge brackets 12 must be moved between a closed position or first angular orientation relative to the vehicle body and an open position or second angular orientation relative to the vehicle body. The hinge system 10 is shown attached to a vehicle and vehicle door in FIG. 5, wherein the vehicle fender has been removed for purposes of clarity. With reference to FIGS. 3A–3C, use of the hinge system 10 to releasably retain the door 48 in any one of two angular orientations is illustrated.

With reference to FIG. 3A in which the door is in a closed position or first angular orientation and the latching portion 82 is engaged with one of the engagement points 68 on the contact body 20, rotational movement of the door 48 from a closed position toward an open position causes the latching device 18 to rotate with the door hinge bracket 12, thereby resiliently deforming the engagement portion 80 and causing the latching portion 82 to snap out of or withdraw from the one engagement point 68 and slide over the outer surface 66 of the contact body 20 (FIG. 6B) toward the other engagement point. Further rotation of the door 48 into the open position causes the latching portion 82 to snap into or be received by the other engagement point 68, thereby holding or checking the door hinge bracket 12 and door 48 in the open position or second angular orientation. The door may be returned to the closed position or first angular orientation, as desired, by reversing the direction of rotation of the door.

It is believed apparent that the various alternative embodiments of the latching device, illustrated in FIGS. 6A–6D, will perform identically in releasably holding the door in the first and second angular orientations. It is further believed that the first and second orientations may be different than the closed and opened positions illustrated, and that intermediate angular positions in which the door may be retained may easily be added by introducing one or more further engagement points between the two engagement points illustrated in the drawings. It is further noted that the open position and closed positions are relative terms, and while the closed position will ordinarily be a fully closed position, the open position may be an angular orientation short of the 'full open' position.

When checking of the door position is no longer desired, such as at the end of the painting operations, the latching device 18 may be removed from the hinge system 10, while the remainder of the hinge system (i.e., the contact body 20) remains in place. While it may be preferred that the latching device be entirely removed or detached from the door hinge bracket 12, it is contemplated that the engagement portion 80 may be cut or severed, while the attachment portion 79, 79*a*–79*d* remains affixed to the door hinge bracket 12.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents.

What is claimed is:

1. A hinge system that is adapted to releasably retain a vehicle door in a desired angular orientation on a vehicle body, comprising:

a pillar hinge bracket adapted to be secured to the vehicle body;

a door hinge bracket adapted to be secured to the vehicle door, said door hinge bracket including first and second mounting ears and a U-shaped intermediate member extending between and interconnecting the first and second mounting ears, said door hinge bracket being movable together with the door between a first angular orientation relative to said pillar hinge bracket and a second angular orientation relative to said pillar hinge bracket;

a hinge pin extending through the pillar hinge bracket and the door hinge bracket and relative to which the door hinge bracket is rotatable;

a contact body affixed to the hinge pin and including at least first and second engagement points;

a latching device movable with respect to the contact body, the latching device including an attachment portion, an engagement portion, and a latching portion, said attachment portion being secured to said intermediate member of said door hinge bracket, said engagement portion extending from said attachment portion and relatively away from said door bracket intermediate portion and toward said contact body, and said engagement portion providing said latching portion and being adapted to bias said latching portion into engagement with said contact body such that said latching portion is selectively engageable with the contact body engagement points so as to be releasably engaged with said first engagement point when said door hinge bracket is in said first angular orientation and to be releasably engaged with said second engagement point when said door hinge bracket is in said second angular orientation.

2. The hinge system of claim 1, wherein the contact body includes a generally circular exterior surface.

3. The hinge system of claim 2, wherein the contact body is concentric with the hinge pin.

4. The hinge system of claim 2, wherein the engagement points are located upon the exterior surface of the contact body.

5. The hinge system of claim 1, wherein the first engagement point is a first recess in the contact body and the second engagement point is a second recess in the contact body, and wherein the latching portion is selectively received in one of said first and second recesses.

6. The hinge system of claim 1, wherein the engagement points are recesses.

7. A method of using a door hinge assembly to selectively releasably retain a door in any one of a plurality of positions relative to a vehicle body, wherein said door hinge assembly includes a pillar hinge bracket, a door hinge bracket, a hinge pin affixed to said pillar hinge bracket and about which said door hinge bracket rotates, a contact body affixed to said hinge pin, and a latching device extending between said door hinge bracket and said contact body, said door hinge bracket including first and second mounting ears affixed to said door and an intermediate portion extending between the first and second ears and spaced a distance from said door, said contact body having at least two engagement points and said latching device including an attachment portion, an engagement portion, and a latching portion comprising the steps of:

securing the attachment portion of the latching device to the intermediate portion of the door hinge bracket such that said latching device engagement portion extends away from said intermediate portion and toward the contact body, said engagement portion biasing the latching portion into engagement with the contact body;

engaging said latching portion with a first of said at least two engagement points so as to releasably retain said door and said door hinge bracket in a first angular orientation relative to said vehicle body;

applying a force to said door and thereby causing said latching portion to move away from said first of said at least two engagement points and toward a second of said at least two engagement points while rotating said door hinge bracket about said hinge pin; and, continuing to apply force to said door and thereby causing said latching portion to engage said second of said at least two engagement points and thereby releasably retain said door and said door hinge bracket in a second angular orientation relative to said vehicle.

8. The method according to claim 7, wherein said latching portion slidably rides over an exterior surface of said contact body as said door is rotated from said first angular orientation toward said second angular orientation.

9. The method according to claim 8, wherein said first angular orientation is a closed position of said door and said second angular orientation is an open position of said door.

10. The method according to claim 9, wherein each of said first and second engagement points are recesses and said latching portion is selectively received in one of said first and second recesses.

11. The method according to claim 9, wherein said latching device includes a biasing member that urges said latching portion into engagement with said contact body.

12. The method according to claim 11, wherein said latching device is releasably affixed to said door hinge bracket.

13. The method according to claim 7, wherein said first angular orientation is a closed position of said door and said second angular orientation is an open position of said door.

14. A method of assembling a hinge assembly comprising a door hinge bracket, a pillar hinge bracket, a hinge pin, a contact body, and a latching device, said door hinge bracket including first and second mounting ears and an intermediate portion extending between the first and second ears, said intermediate portion including an upper leg, a lower leg, and a base, said upper leg extending between the first ear and the base, said lower leg extending between the second ear and the base, and said base interconnecting said upper and lower legs, comprising the steps of:

aligning openings in said door hinge bracket, said pillar hinge bracket, and said contact body;

inserting said hinge pin through said aligned openings;

securing said hinge pin to said pillar hinge bracket and said contact body such that said hinge pin, contact body, and pillar hinge bracket are immovably affixed to one another;

securing said hinge pin to said door hinge bracket such that said door hinge bracket is rotatable about said hinge pin;

securing an attachment portion of said latching device to said base of said intermediate portion of the door hinge bracket such that said latching device moves with said door hinge bracket, said latching device including an engagement portion that extends away from said door hinge bracket and toward said contact body, said engagement portion including a latching portion that is in sliding engagement with an exterior surface of said contact body; and, wherein said contact body includes at least two engagement points and said latching portion is selectively received by a first of said at least two engagement points when said door hinge bracket is in a first angular orientation relative to said pillar hinge bracket and is received by a second of said at least two engagement points when said door hinge bracket is in a second angular orientation relative to said pillar hinge bracket.

* * * * *